US010453595B2

(12) United States Patent
Hidaka et al.

(10) Patent No.: US 10,453,595 B2
(45) Date of Patent: Oct. 22, 2019

(54) RARE EARTH PERMANENT MAGNET

(71) Applicant: TDK CORPORATION, Tokyo (JP)

(72) Inventors: Tetsuya Hidaka, Tokyo (JP); Yuki Nagamine, Tokyo (JP); Yoshinori Fujikawa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 208 days.

(21) Appl. No.: 15/443,748

(22) Filed: Feb. 27, 2017

(65) Prior Publication Data

US 2017/0250014 A1 Aug. 31, 2017

(30) Foreign Application Priority Data

Feb. 29, 2016 (JP) ..... 2016-037793

(51) Int. Cl.

| | |
|---|---|
| ***H01F 1/053*** | (2006.01) |
| ***C22C 38/00*** | (2006.01) |
| ***H01F 1/08*** | (2006.01) |
| ***H01F 1/057*** | (2006.01) |

(52) U.S. Cl.

CPC ..... *H01F 1/0536* (2013.01); *C22C 38/005* (2013.01); *H01F 1/0577* (2013.01); *H01F 1/086* (2013.01)

(58) Field of Classification Search

None

See application file for complete search history.

(56) References Cited

U.S. PATENT DOCUMENTS

| | | | | |
|---|---|---|---|---|
| 5,858,123 | A | 1/1999 | Uchida et al. | |
| 5,997,804 | A | 12/1999 | Uchida et al. | |
| 6,080,245 | A | 6/2000 | Uchida et al. | |
| 9,773,599 | B2 * | 9/2017 | Miwa | H01F 7/021 |
| 10,083,783 | B2 * | 9/2018 | Fujikawa | H01F 1/0577 |
| 10,096,410 | B2 * | 10/2018 | Miwa | H01F 1/0577 |
| 2004/0187969 | A1 * | 9/2004 | Ishizaka | H01F 1/0577 148/302 |
| 2006/0292395 | A1 * | 12/2006 | Mori | C22C 38/005 428/692.1 |
| 2007/0144615 | A1 * | 6/2007 | Komuro | H01F 1/0572 148/105 |
| 2007/0151632 | A1 * | 7/2007 | Komuro | H01F 1/0577 148/300 |
| 2009/0224615 | A1 | 9/2009 | Komuro et al. | |
| 2011/0128106 | A1 | 6/2011 | Mori et al. | |
| 2011/0200839 | A1 | 8/2011 | Marinescu et al. | |

(Continued)

FOREIGN PATENT DOCUMENTS

| | | |
|---|---|---|
| CN | 101552066 A | 10/2009 |
| DE | 112011100574 T5 | 2/2013 |

(Continued)

OTHER PUBLICATIONS

Derwent Abstract Translation of WO 2015/002280 A1. (Year: 2015).*

(Continued)

*Primary Examiner* — Kevin M Bernatz

(74) *Attorney, Agent, or Firm* — Oliff PLC

(57) ABSTRACT

A rare earth permanent magnet includes a main phase composed of a main phase particle and a grain boundary present among a plurality of the main phase particles. The grain boundary includes a region whose electric resistance is higher than that of the main phase.

5 Claims, 4 Drawing Sheets

(56) References Cited

U.S. PATENT DOCUMENTS

| | | | | |
|---|---|---|---|---|
| 2012/0114515 | A1* | 5/2012 | Kaneko | B22F 1/0088 419/10 |
| 2014/0271323 | A1* | 9/2014 | Wang | H01F 41/0266 419/25 |
| 2015/0097642 | A1 | 4/2015 | Takagi | |
| 2015/0155082 | A1 | 6/2015 | Marinescu et al. | |
| 2015/0155083 | A1 | 6/2015 | Miwa et al. | |
| 2015/0235750 | A1* | 8/2015 | Miwa | H01F 7/021 335/302 |

FOREIGN PATENT DOCUMENTS

| | | | |
|---|---|---|---|
| DE | 102014114390 | A1 | 7/2015 |
| JP | 2003-134750 | A | 5/2003 |
| JP | 2007-194599 | A | 8/2007 |
| WO | 2013/122256 | A1 | 8/2013 |

OTHER PUBLICATIONS

Derwent Abstract Translation of WO 2013/122255 A1. (Year: 2013).*

Gottstein, Günter et. al., "Physikalische Grundlagen der Materialkunde", 2001, 61f.

Dec. 4, 2017 Office Action issued in German Patent Application No. 102017203197.2.

* cited by examiner

RARE EARTH PERMANENT MAGNET

BACKGROUND OF THE INVENTION

1. Field of the Invention

The present invention relates to a rare earth permanent magnet.

2. Description of the Related Art

Ferrite sintered magnets have been conventionally used as magnets for high-speed rotating motors. In accordance with demand in higher performance, however, motors using rare earth permanent magnets instead of the ferrite sintered magnets are widely used these days.

In recent years, a rotation speed tends to further increase in accordance with higher efficiency of the motors, and a field weakening control method is commonly applied for controlling the motors.

In the above two cases, a large eddy current flows through the magnet. A rare earth sintered magnet has an electric resistance that is smaller than an electric resistance of the ferrite sintered magnet. Thus, it is known that a large eddy current flows in case of using a rare earth sintered magnet for the motor, and that this magnet is demagnetized due to heat generated by the eddy current.

Patent Document 1 discloses a method for preventing an eddy current by dividing a rare earth sintered magnet and coating its entire surface with resin as insulation treatment.

Patent Document 1: JP 2003-134750 A

SUMMARY OF THE INVENTION

However, when a magnet is divided, loads of each step of cutting, grinding, adhering, and assembling increase. In addition, when a protection layer such as resin coating is provided, a step of providing this protection layer increases its own load. Thus, the method disclosed in Patent Document 1 is disadvantageous in high cost and low productivity.

It is an object of the invention to prevent an eddy current more simply by increasing electric resistance more highly than that of the conventional rare earth permanent magnet.

To overcome the above problems, a rare earth permanent magnet according to the present invention is a rare earth permanent magnet including a main phase composed of a main phase particle and a grain boundary present among a plurality of the main phase particles, wherein the grain boundary includes a region whose electric resistance is higher than that of the main phase.

The rare earth permanent magnet according to the present invention has the above features, and thus can increase electric resistance of the entire magnet and prevent generation of eddy current.

The rare earth permanent magnet is an R-T-B based rare earth permanent magnet,

R is a rare earth element, T is Fe or Fe and Co, and B is boron, the rare earth permanent magnet may contain Al, Cu, Ga, Zr, O, C, and N in addition to R, T, and B, and R is contained at 28.5 to 33.5 mass %, B is contained at 0.7 to 1.1 mass %, Al is contained at 0.03 to 0.6 mass %, Cu is contained at 0.01 to 1.5 mass %, Co is contained at 0 to 3.0 mass % (excluding zero), Ga is contained at 0 to 1.0 mass % (including zero), Zr is contained at 0 to 1.5 mass % (including zero), O is contained at 0.03 to 0.8 mass %, C is contained at 0.02 to 0.3 mass %, and N is contained at 0.01 to 0.1 mass %, provided that the entire rare earth permanent magnet is 100 mass %.

Preferably, the grain boundary is classified into a two-grain interface present between the two main phase particles and a grain boundary triple junction present among the three or more main phase particles, and the region whose electric resistance is high is present in the grain boundary triple junction.

Preferably, a highest electric resistance in the region whose electric resistance is high is 10 times or more than a lowest electric resistance in the main phase.

Preferably, an average value of electric resistance in the region whose electric resistance is high is 10 times or more than an average value of electric resistance in the main phase.

Preferably, the region whose electric resistance is high is softer than the main phase.

Preferably, the grain boundary includes a region whose electric resistance is lower than that of the main phase.

Preferably, the region whose electric resistance is low is present in the two-grain interface.

Preferably, a lowest electric resistance in the region whose electric resistance is low is 0.1 times or less than a highest electric resistance in the main phase.

Preferably, an average value of electric resistance in the region whose electric resistance is low is 0.1 times or less than an average value of electric resistance in the main phase.

Preferably, the region whose electric resistance is low is harder than the main phase.

The rare earth permanent magnet according to the present invention may be a rare earth sintered magnet.

DESCRIPTION OF THE PREFERRED EMBODIMENTS

Figure 1:
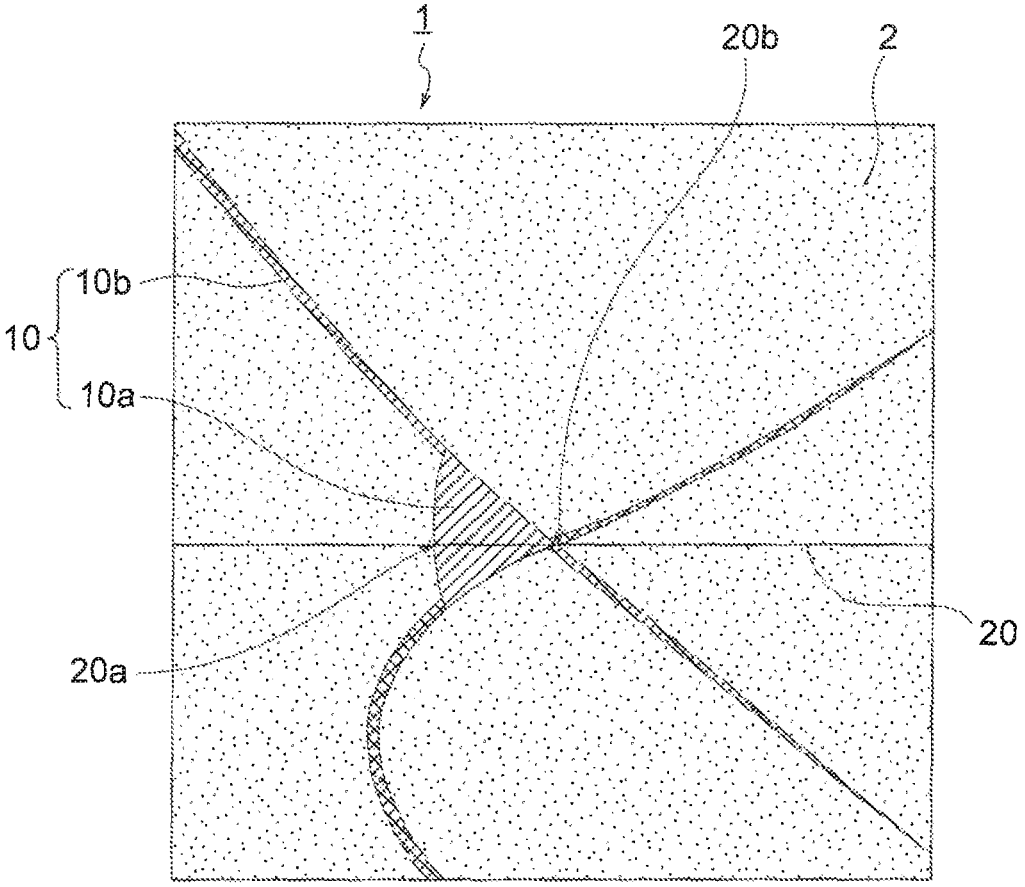
FIG. 1 is a schematic view of a rare earth sintered magnet in Example of the present invention.

Hereinafter, an embodiment of the present invention will be described, but the present invention is not limited to the embodiment shown below.

<Rare Earth Sintered Magnet>

A rare earth sintered magnet according to the present embodiment is an R-T-B based rare earth sintered magnet.

R is a rare earth element. R may be contained at 28.5 mass % to 33.5 mass %. R is any kind of rare earth elements. For example, Nd can be used as R.

T is Fe or Fe and Co. In the present embodiment, Co may be contained at more than 0 mass % to 3.0 mass %.

Al may be contained at 0.03 to 0.6 mass %. Cu may be contained at 0.01 to 1.5 mass %. Ga may be contained at 1.0 mass % or less. Zr may be contained at 1.5 mass % or less.

A content of Fe is a substantial remaining part of constituents of the R-T-B based rare earth sintered magnet.

B is boron. B may be contained at 0.7 mass % to 1.1 mass %.

C may be contained at 0.02 to 0.3 mass %. N may be contained at 0.01 to 0.1 mass %.

Furthermore, the rare earth sintered magnet according to the present embodiment may contain inevitable impurities. The inevitable impurities are not limited to a specific kind or content, and may be contained in a range where characteristics of the rare earth sintered magnet according to the present embodiment are not largely damaged.

A rare earth sintered magnet 1 according to the present embodiment is not limited to a specific size.

The rare earth sintered magnet according to the present embodiment includes a main phase composed of a main phase particle and a grain boundary present among a plurality of the main phase particles. The main phase according to the present embodiment is $R_2T_{14}B$ phase. The grain boundary is classified into a two-grain interface present between the two main phase particles and a grain boundary triple junction present among the three or more main phase particles.

In the R-T-B based rare earth sintered magnet according to the present embodiment, the grain boundary includes a region whose electric resistance is higher than that of the main phase. The region whose electric resistance is high is normally present in the grain boundary triple junction. Although the mechanism is unclear, it makes it easier to improve electric resistance of the entire magnet and prevent generation of an eddy current by including the region whose electric resistance is high in the grain boundary triple junction.

In the present embodiment, a highest electric resistance in the region whose electric resistance is high is preferably 10 times, more preferably 100 times, or more than a lowest electric resistance in the main phase.

Furthermore, an average value of electric resistance in the region whose electric resistance is high is preferably 10 times, more preferably 100 times, or more than an average value of electric resistance in the main phase.

Preferably, the region whose electric resistance is high is softer than the main phase.

Preferably, the grain boundary includes a region whose electric resistance is lower than that of the main phase.

Preferably, a lowest electric resistance in the region whose electric resistance is low is 0.1 times or less than a highest electric resistance in the main phase.

Preferably, an average value of electric resistance in the region whose electric resistance is low is 0.1 times or less than an average value of electric resistance in the main phase.

Preferably, the region whose electric resistance is low is harder than the main phase.

Observation of fine structure, measurement of electric resistance, and measurement of hardness with respect to the R-T-B based rare earth sintered magnet according to the present embodiment are carried out by any method, such as a Scanning Spread Resistance Microscope mode (SSRM) of a Scanning Probe Microscope (SPM).

In the SSRM mode, a bias voltage is applied to a sample, and a current flowing through a conductive probe is detected by a wide-range logarithmic amplifier to be measured as a resistance value. At this time, the bias voltage being applied concentrates on right under the probe. In accordance with this principle, it is possible to detect a local current value right under the probe and calculate an electric resistance. Then, a mapping image based on variation of electric resistance can be obtained in a scanned measurement range.

The measurement range of the wide-range logarithmic amplifier is not limited. The probe is not limited to a specific kind, but a probe of B doped diamond coating type is particularly employed as abrasion can be prevented even under a high load.

The scanning in the SSRM mode may be carried out in a Sampling Intelligent Scan (SIS) mode to prevent damage of the probe and influence of polishing waste.

The SIS mode is a scanning mode of making the probe closer during data acquisition and retracting the probe over the sample except during data acquisition. The number of contact times between the probe and the sample can be reduced by using the SIS mode. Then, a measurement error can be reduced by eliminating influence of a force in a horizontal direction.

A sample before the measurement is substantially flat. Furthermore, a surface oxide layer is formed on a measurement surface of the sample. Even if a measurement range of the sample is once scanned under this state, two-dimensional images to be obtained fail to become clear with respect to both an image according to variation of electric resistance and an image according to variation of height difference. During the scanning, however, the probe is brought into contact with the sample and scratches it. At this time, it is conceivable that a softer portion of the sample is more scratched, and a harder portion of the sample is less scratched. It is thus conceivable that a hard portion of the sample becomes higher and a softer portion of the sample becomes lower as the scanning is repeated. Then, a hard portion of the sample and a soft portion of the sample can be distinguished based on height information finally obtained by performing scanning multiple times. A clear two-dimensional image of the image according to variation of electric resistance can be also obtained by performing scanning multiple times to eliminate the surface oxide layer.

Hereinafter, a measurement method in the SSRM mode practically using the SPM will be described.

First, a size of an R-T-B based rare earth sintered magnet is adjusted to fabricate an observation sample. The observation sample is of a size large enough to be housed within a sample holder of the SPM.

Next, a sintered magnet surface to be an observation surface is mirror polished by any method. The observation sample after the mirror polishing is immediately vacuum packed and is taken out into the air just before the observation. This is because the observation sample after the mirror polishing is easily oxidized.

Next, the observation sample is set to a sample holder. Then, the observation sample and the sample holder are conducted by any method. The observation sample and the sample holder may be conducted by directly bringing themselves into contact with each other or may be conducted by using a silver paste, a carbon paste, or the like. When the observation sample and the sample holder are conducted using a paste, attention should be paid to avoid attaching the paste onto the observation surface.

Next, the observation surface of the observation sample is scanned in the SSRM mode. This scanning is carried out in a vacuum. Any bias voltage is determined while an observation image is being confirmed. The same point is scanned multiple times to eliminate the surface oxide layer and obtain a clear observation image. Then, a two-dimensional electric resistance image whose color differs in accordance with a magnitude of the electric resistance is obtained.

When the scanning is performed multiple times, a height difference in accordance with a hardness of the observation surface occurs. A two-dimensional height difference image whose color differs in accordance with the height difference is obtained.

Interfaces between the main phases and the grain boundaries are determined by visual observation with reference to the electric resistance image and the height difference image. Then, a measurement line is set to observe variations of the height difference and the electric resistance on the measurement line.

<Manufacturing Method of R-T-B Based Sintered Magnet>

Next, a manufacturing method of the R-T-B based sintered magnet according to the present embodiment will be described.

In the manufacture of the sintered magnet, first, raw material metals of each constituent element of the sintered magnet are prepared, and a raw material alloy is fabricated using the raw material metals by a strip casting method or so. The raw material metals include rare earth metals, rare earth alloys, pure iron, ferro-boron, alloy of these, or the like. Then, the raw material alloy capable of obtaining a desired composition of the sintered magnet is fabricated using the raw material metals. Incidentally, a plurality of alloys whose compositions are different may be prepared as the raw material alloy.

Next, the raw material alloy is pulverized to obtain a raw material alloy powder. The pulverization of the raw material alloy is preferably carried out by two steps of a coarse pulverization step and a fine pulverization step. The coarse pulverization step may be carried out using a stamping mill, a jaw crusher, a disk mill, or the like in an inert gas atmosphere. The coarse pulverization step may be also carried out by a hydrogen pulverization. In the coarse pulverization, the raw material alloy is pulverized until its grain diameter becomes about hundreds μm.

Next, in the fine pulverization step, the pulverized material obtained in the coarse pulverization step is further finely pulverized until an average grain diameter becomes 3 to 5 μm. Incidentally, the raw material alloy may be pulverized by only one step of the fine pulverization. In case of preparing multiple kinds of the raw material alloy, these raw material alloys may be separately pulverized and mixed.

Then, the raw material powder thus obtained is pressed in a magnetic field to obtain a green compact. More specifically, the raw material powder is pressed in such a manner that the raw material powder is filled in a metal mold arranged in an electromagnet and is subsequently pressed while a magnetic field by the electromagnet is being applied to orient a crystal axis of the raw material powder. The raw material powder is pressed at a magnetic field of 950 to 1600 kA/m at a pressure of about 30 to 300 MPa, for example.

After the pressing in the magnetic field, the green compact is sintered in a vacuum or in an inert gas atmosphere to obtain a sintered body. Sintering conditions are appropriately determined, and may be 1000 to 1100° C. for 1 to 24 hours, for example.

Then, an aging treatment is performed against the sintered body as necessary to obtain a sintered magnet. Performing the aging treatment tends to improve coercivity HcJ of the rare earth magnet to be obtained. The aging treatment may be performed by one step, but is preferably performed by two steps.

A sintered magnet of a favorable embodiment is obtained in the above-mentioned method, but a manufacturing method of the sintered magnet is not limited to the above and may be appropriately changed. Another embodiment of the present invention relates to an R-T-B based permanent magnet manufactured by hot working. The method for manufacturing the R-T-B based permanent magnet by hot working has the following steps.

(a) Melt rapid cooling step for melting a raw material metal and rapidly cooling an obtained molten metal to obtain a ribbon (b) Pulverization step for pulverizing the ribbon to obtain a flaky raw material powder (c) Cold forming step for performing cold forming to the pulverized raw material powder (d) Preliminary heating step for preliminarily heating the cold-formed body (e) Hot forming step for performing hot forming to the preliminarily heated cold-formed body (f) Hot plastic working step for plastically deforming the hot-formed body into a predetermined shape (g) Aging treatment step for performing an aging treatment to the R-T-B based permanent magnet

EXAMPLES

Hereinafter, the present invention will be described based on a more detailed example, but is not limited thereto.

Manufacture of Sintered Magnet

First, raw material metals of a sintered magnet were prepared, and a raw material alloy was fabricated using the raw material metals by a strip casting method so that a sintered magnet has a composition of 23.8 Nd-7.2 Pr-0.85 B-2.0 Co-0.4 Al-0.3 Cu-0.4 Ga-0.2 Zr-0.07 O-0.12 C-0.06 N-remaining part Fe (unit: mass %). Incidentally, contents of Nd, Pr, Fe, Co, Ga, Al, Cu, and Zr of each element were measured by a fluorescent X-ray analysis. The content of B was measured by ICP emission analysis. The content of O was measured by an inert gas fusion—non-dispersive infrared absorption method. The content of N was measured by an inert gas fusion—thermal conductivity method. The content of C was measured by a combustion in oxygen stream-infrared absorption method.

Next, hydrogen was stored in the obtained raw material alloy, and then a hydrogen pulverization treatment for performing dehydrogenation in an Ar atmosphere at 600° C. for 1 hour was carried out. Incidentally, in the present example, each step from the hydrogen pulverization treatment to firing was carried out in an atmosphere whose oxygen concentration was less than 100 ppm.

Then, a lauric acid amide of 0.15 mass % as a pulverization assistant was added to the powder after the hydrogen pulverization and mixed. After this mixing, a fine pulverization was performed using a jet mill to obtain a raw material powder whose average grain diameter was 3.5 μm. Incidentally, the content of C contained in the sintered magnet finally obtained can be adjusted by adjusting the additive content of the lauric acid amid or so during the fine pulverization. The raw material powder after the fine pulverization was filled in a metal mold arranged in an electromagnet and pressed at a pressure of 100 MPa while applying a magnetic field of 1200 kA/m, whereby a green compact was obtained. Incidentally, a zinc stearate as an external lubricant was adhered to the metal mold per one shot during the pressing.

The green compact was sintered in a vacuum at 1070° C. for 12 hours and rapidly cooled to obtain a sintered body. Then, the obtained sintered body was subjected to a two-step aging treatment consisting of one step performed in an Ar atmosphere at 800° C. for 2 hours and one step performed in an Ar atmosphere at 510° C. for 4 hours to obtain the sintered magnet having the above composition.

Characteristic Evaluation

Residual magnetic flux density Br and coercivity HcJ of the sintered magnet were respectively measured using a B—H tracer. As a result, Br=1390 mT and HcJ=1616 kA/m were found.

Observation of Electric Resistance and Hardness

Electric resistance and hardness of the sintered magnet were observed. Specifically, a SSRM mode of a SPM was employed. The apparatuses used were AFM5000 and AFM5300E, both of which had been made by Hitachi High-Technologies Corporation. In the present example, a probe of B doped diamond coating type was used. To prevent damage of the probe and influence of polishing waste, the SSRM mode was used in a SIS mode.

First, an observation sample was made by adjusting the size of the sintered magnet. The size of the observation sample was an observation surface of about 10 mm square and 5 mm thickness.

Next, a sintered magnet surface (a surface vertical to a magnetic field orientation direction) to be the observation surface was mirror polished. Specifically, first, the sintered magnet surface was coarsely polished in a dry manner using a sandpaper of #180, a sandpaper of #400, a sandpaper of #800, and a sandpaper of #1200 in this order. Thereafter, the sintered magnet surface was polished using a polishing cloth to which diamond abrasive grains of 6 μm were adhered and a DP-Lubricant Blue made by Marumoto Struers. Furthermore, the sintered magnet surface was polished using a polishing cloth to which diamond abrasive grains of 0.5 μm were adhered and the DP-Lubricant Blue. Finally, the sintered magnet surface was finished using a polishing cloth and a solution where $Al_2O_3$ particles of 0.06 μm were dispersed in an alcohol. The observation sample after the mirror polishing was immediately vacuum-packed and retracted into the air just before the observation.

Next, the observation sample was set to a sample holder. In the present example, the observation sample and the sample holder were conducted by directly bringing themselves into contact with each other.

Next, the observation surface of the observation sample was observed in the SSRM mode in a vacuum. The same point was scanned multiple times to eliminate the surface oxide layer and obtain a clear observation image. Then, a two-dimensional electric resistance image whose color differs in accordance with a magnitude of the electric resistance was obtained. The bias voltage was 0.1V.

The scanning was carried out multiple times, and thus a height difference in accordance with a hardness of the observation surface occurred. A two-dimensional height difference image whose color differed in accordance with the height difference was obtained.

Interfaces between the main phases and the grain boundaries were determined by visual observation with reference to the electric resistance image and the height difference image. Then, a measurement line was set to observe variations of the height difference and the electric resistance on the measurement line.

Figure 2:
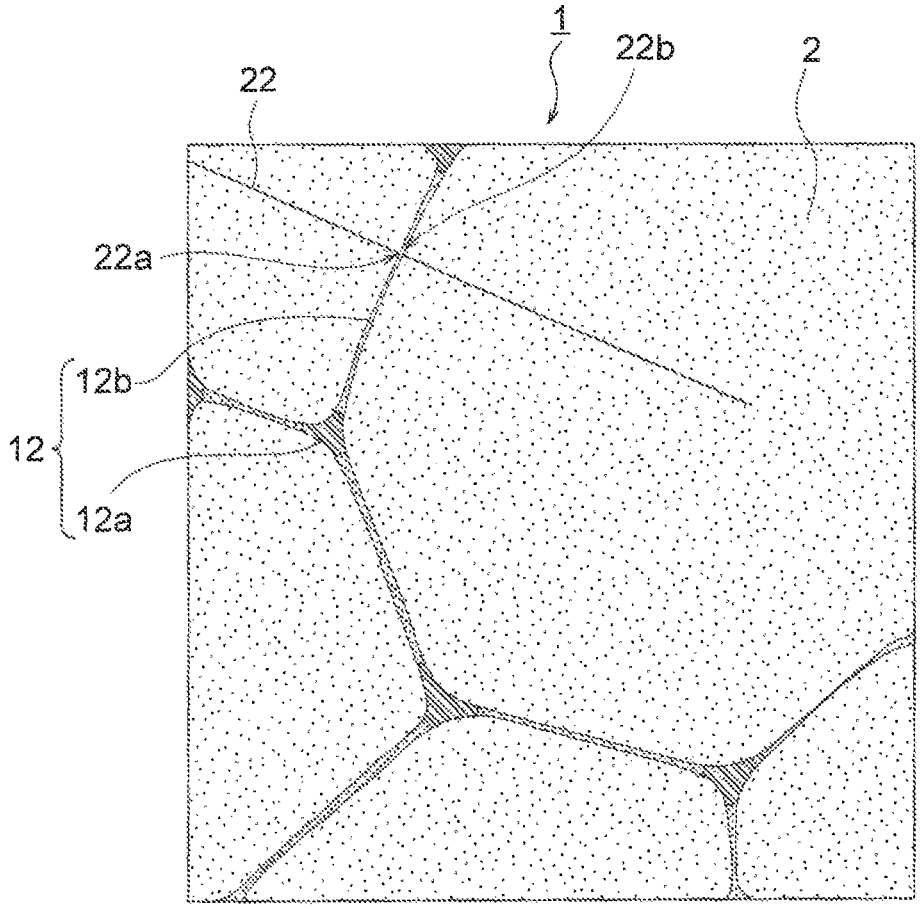
FIG. 2 is a schematic view of a rare earth sintered magnet in Example of the present invention.

FIG. 1 is a schematic view distinguishing a main phase and a grain boundary based on the electric resistance image and the height difference image in a certain measurement range of the above sintered magnet. FIG. 2 is a schematic view distinguishing a main phase and a grain boundary based on the electric resistance image and the height difference image in another measurement range of the above sintered magnet.

Figure 3:
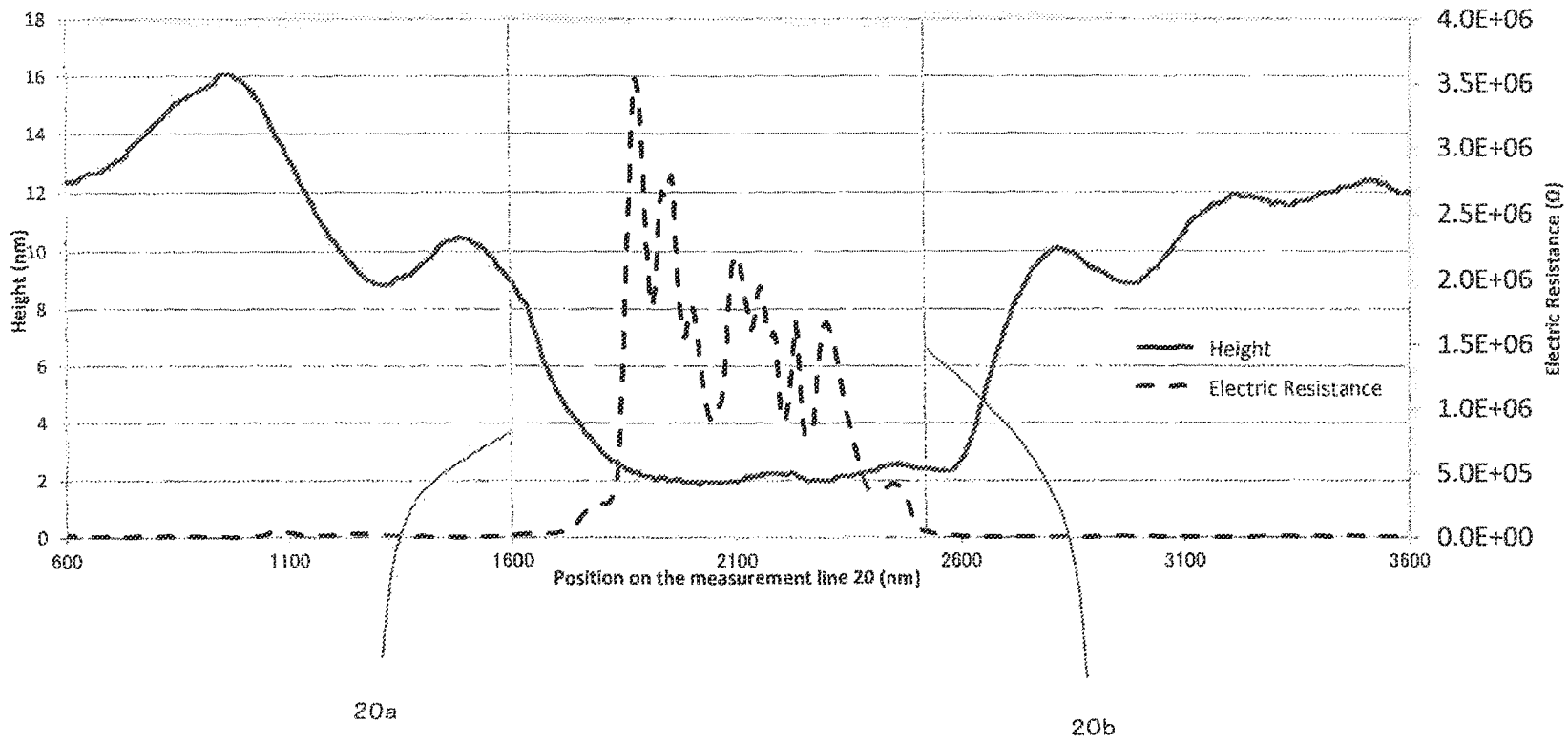
FIG. 3 is a graph showing height and electric resistance on a measurement line of FIG. 1.
Figure 4:
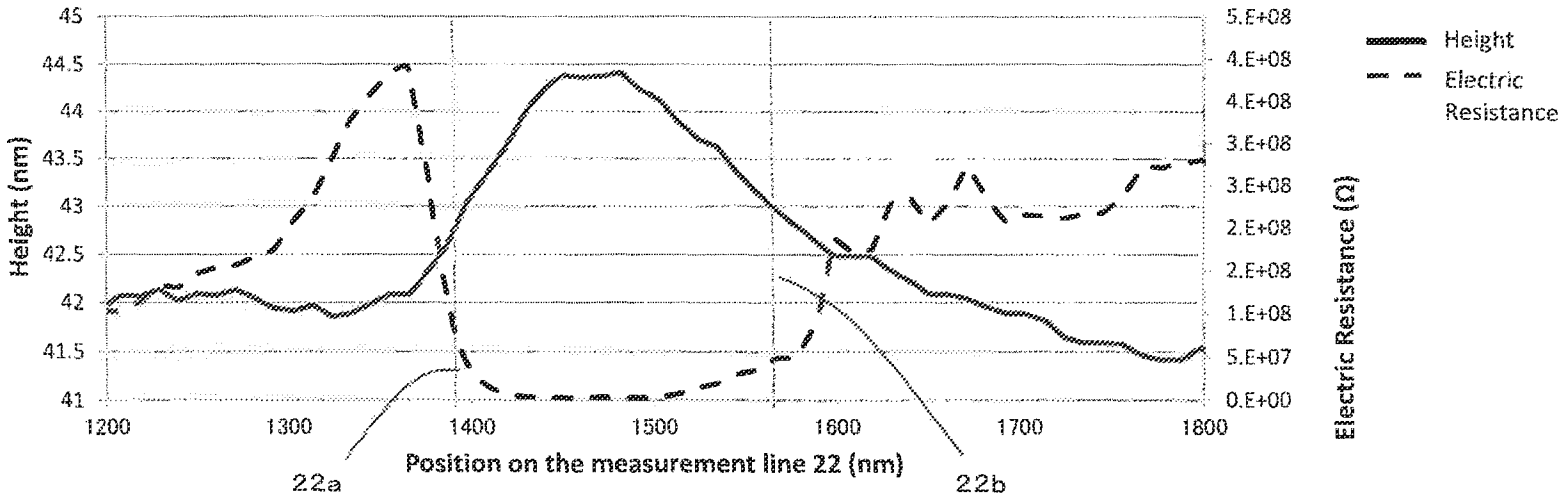
FIG. 4 is a graph showing height and electric resistance on a measurement line of FIG. 2.

A measurement line 20 of FIG. 1 is a measurement line configured to pass through main phases 2 and a grain boundary triple junction 10*a* in FIG. 1. A measurement line 22 of FIG. 2 is a measurement line configured to pass through main phases 2 and a two-grain interface 12*b* in FIG. 2. FIG. 3 is a graph showing a variation of height and a variation of electric resistance on the measurement line 20 of FIG. 1. FIG. 4 is a graph showing a variation of height and a variation of electric resistance on the measurement line 22 of FIG. 2. FIG. 3 and FIG. 4 are graphed by extracting results of part of the measurement lines of FIG. 1 and FIG. 2. In FIG. 3 and FIG. 4, standards of the height difference vary based on differences in initial configuration such as the number of scannings. A degree of removal of a surface oxide layer is not uniform due to differences in initial configuration such as the number of scannings with respect to electric resistance. Arrangement of the main phases and the grain boundaries inside the sample also varies in accordance with a measurement point. Then, FIG. 3 and FIG. 4 are obtained by directly graphing values outputted by the measurement apparatuses. Thus, the height described in FIG. 3 and the height described in FIG. 4 cannot be directly compared. The electric resistance described in FIG. 3 and the electric resistance described in FIG. 4 cannot be directly compared either.

FIG. 3 was used to calculate an average value of the electric resistance of the main phase 2 in a range of 1 μm located left of an interface 20*a* and an average value of the electric resistance of the main phase 2 in a range of 1 μm located right of an interface 20*b*. Furthermore, an average value of the electric resistance of a grain boundary triple junction 10*a* present between the interface 20*a* and the interface 20*b* was calculated. The results are shown in Table 1.

TABLE 1

| | Average value of electric resistance (Ω) |
|---|---|
| Grain boundary triple junction | 1.05E+06 |
| Left side main phase 1 μm | 1.37E+04 |
| Right side main phase 1 μm | 7.47E+03 |

FIG. 4 was used to calculate an average value of the electric resistance of the main phase 2 in a range of 1 μm located left of an interface 22*a* and an average value of the electric resistance of the main phase 2 in a range of 1 μm located right of an interface 22*b*. Furthermore, an average value of the electric resistance of a two-grain interface 12*b* present between the interface 22*a* and the interface 22*b* was calculated. The results are shown in Table 2.

TABLE 2

| | Average value of electric resistance (Ω) |
|---|---|
| Two-grain interface | 1.29E+07 |
| Left side main phase 1 μm | 1.94E+08 |
| Right side main phase 1 μm | 1.88E+08 |

FIG. 1, FIG. 3, and Table 1 show that a grain boundary triple junction whose electric resistance is higher than that of the main phase and whose height is lower (softer) than the main phase is present in the sintered magnet of the present example. FIG. 2, FIG. 4, and Table 2 show that a two-grain interface whose electric resistance is lower than that of the main phase and whose height is higher (harder) than the main phase is present in the sintered magnet of the present example.

NUMERICAL REFERENCES

1 . . . rare earth sintered magnet
2 . . . main phase
10, 12 . . . grain boundary
  10*a*, 12*a* . . . grain boundary triple junction
  10*b*, 12*b* . . . two-grain interface
20, 22 . . . measurement line
  20*a*, 20*b*, 22*a*, 22*b* . . . interface between main phase and grain boundary

The invention claimed is:

1. A rare earth permanent magnet comprising a plurality of main phase particles and grain boundaries present among a plurality of the main phase particles, wherein the grain boundary includes a region whose electric resistance is higher than that of the main phase particles, the grain boundary includes a region whose electric resistance is lower than that of the main phase particles, and the region whose electric resistance is lower than that of the main phase particles is harder relative to hardness than the main phase particles.

2. The rare earth permanent magnet according to claim 1, wherein the region whose electric resistance is lower than that of the main phase particles is present in the two-grain interface.

3. The rare earth permanent magnet according to claim 2, wherein a lowest electric resistance in the region whose electric resistance is lower than that of the main phase particles is 0.1 times or less than a highest electric resistance in the main phase particles.

4. The rare earth permanent magnet according to claim 1, wherein a lowest electric resistance in the region whose electric resistance is lower than that of the main phase particles is 0.1 times or less than a highest electric resistance in the main phase particles.

5. The rare earth permanent magnet according to claim 1, wherein an average value of electric resistance in the region whose electric resistance is lower than that of the main phase particles is 0.1 times or less than an average value of electric resistance in the main phase.

* * * * *